US007082643B2

(12) United States Patent
Lu et al.

(10) Patent No.: US 7,082,643 B2
(45) Date of Patent: Aug. 1, 2006

(54) HINGE

(75) Inventors: Sheng-Nan Lu, Shulin (TW); Hsiang-Chi Chien, Shulin (TW)

(73) Assignee: Shin Zu Shing Co., Ltd., Taipei Hsien (TW)

( * ) Notice: Subject to any disclaimer, the term of this patent is extended or adjusted under 35 U.S.C. 154(b) by 67 days.

(21) Appl. No.: 10/872,374

(22) Filed: Jun. 22, 2004

(65) Prior Publication Data

US 2006/0000060 A1 Jan. 5, 2006

(51) Int. Cl.
*E05D 11/08* (2006.01)

(52) U.S. Cl. ..... 16/340; 16/337

(58) Field of Classification Search ..... 16/340, 16/337, 338, 339; 361/680–638; 248/291.1, 248/917–923

See application file for complete search history.

(56) References Cited

U.S. PATENT DOCUMENTS

| | | | | | |
|---|---|---|---|---|---|
| 4,781,422 | A * | 11/1988 | Kimble | 361/680 |
| 5,190,391 | A * | 3/1993 | Huong | 403/96 |
| 6,125,507 | A * | 10/2000 | Katoh | 16/329 |
| 6,154,925 | A * | 12/2000 | Miura | 16/338 |
| 6,163,928 | A * | 12/2000 | Chung | 16/342 |
| 6,253,419 | B1 * | 7/2001 | Lu | 16/340 |
| 6,421,878 | B1 * | 7/2002 | Kaneko et al. | 16/330 |
| 6,539,582 | B1 * | 4/2003 | Chae | 16/340 |
| 6,666,422 | B1 * | 12/2003 | Lu et al. | 248/291.1 |
| 6,671,928 | B1 * | 1/2004 | Huang | 16/340 |
| 6,779,234 | B1 * | 8/2004 | Lu et al. | 16/340 |
| 6,813,813 | B1 * | 11/2004 | Lu et al. | 16/342 |
| 6,862,779 | B1 * | 3/2005 | Lu et al. | 16/340 |

FOREIGN PATENT DOCUMENTS

| | | | |
|---|---|---|---|
| EP | 1382786 | A1 * | 1/2004 |
| GB | 2279105 | A * | 12/1994 |
| JP | 11044332 | A * | 2/1999 |
| JP | 2002250335 | A * | 9/2002 |
| JP | 2002266841 | A * | 9/2002 |

* cited by examiner

*Primary Examiner*—Chuck Y. Mah
(74) *Attorney, Agent, or Firm*—Rosenberg, Klein & Lee

(57) ABSTRACT

A hinge has a spacer assembly, a rotating device, a pivot shaft and a nut. The rotating device is mounted on a display screen, and the pivot shaft is mounted on a base. The present invention provides a convenience of the screen being foldable parallel to the base.

3 Claims, 6 Drawing Sheets

HINGE

BACKGROUND OF THE INVENTION

1. Field of the Invention

The present invention relates to a hinge, especially to a hinge for a LCD whereby the LCD can be folded parallel to a base supporting the LCD.

2. Description of the Prior Arts

The rapid increase in popularity of LCD screens with computers has resulted in a corresponding demand for improvements in convenience of use of such screens. That is, the cathode ray had such size and weight it was virtually without variation in its position. The LCD screen opened up significant variations in positions of view. The LCD comprises a screen and a base. The conventional hinge is mounted between the screen and the base. The conventional hinge only can rotate the screen backward and forward to a small angle. The hinge keeps the screen standing upright. Then the contact surface of the upright screen is larger than that of a recumbent screen, and this will make the screen easily to be damaged when the contact surface is larger. Therefore when the LCD is shipping from a manufacturer to a retailer or moved from one desk to another, the screen is easy to be damaged.

To overcome the shortcomings, the present invention provides a hinge to mitigate or obviate the aforementioned problems.

SUMMARY OF THE INVENTION

The main objective of the present invention is to provide a hinge that can be folded to 90 degrees. The hinge comprises a spacer assembly, a rotating device, a pivot shaft and a nut. The spacer assembly has multiple fixed spacers, two rotating spacers, a biasing device and a washer. The rotating device has a circular hole and two protrusions. The pivot shaft has a fixed shaft, a penetrating shaft and a thread.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
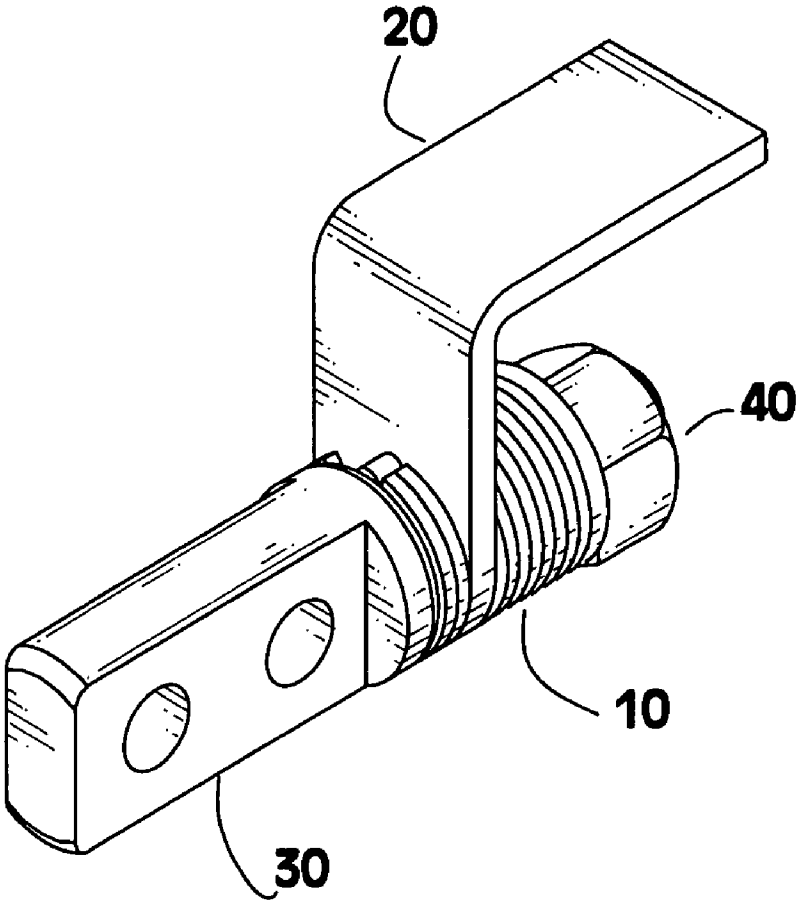
FIG. 1 is a perspective view of a hinge in accordance of the present invention.

With reference to FIG. 1, a hinge in accordance with the present invention comprises a spacer assembly (10), a rotating device (20), a pivot shaft (30) and a nut (40).

Figure 2:
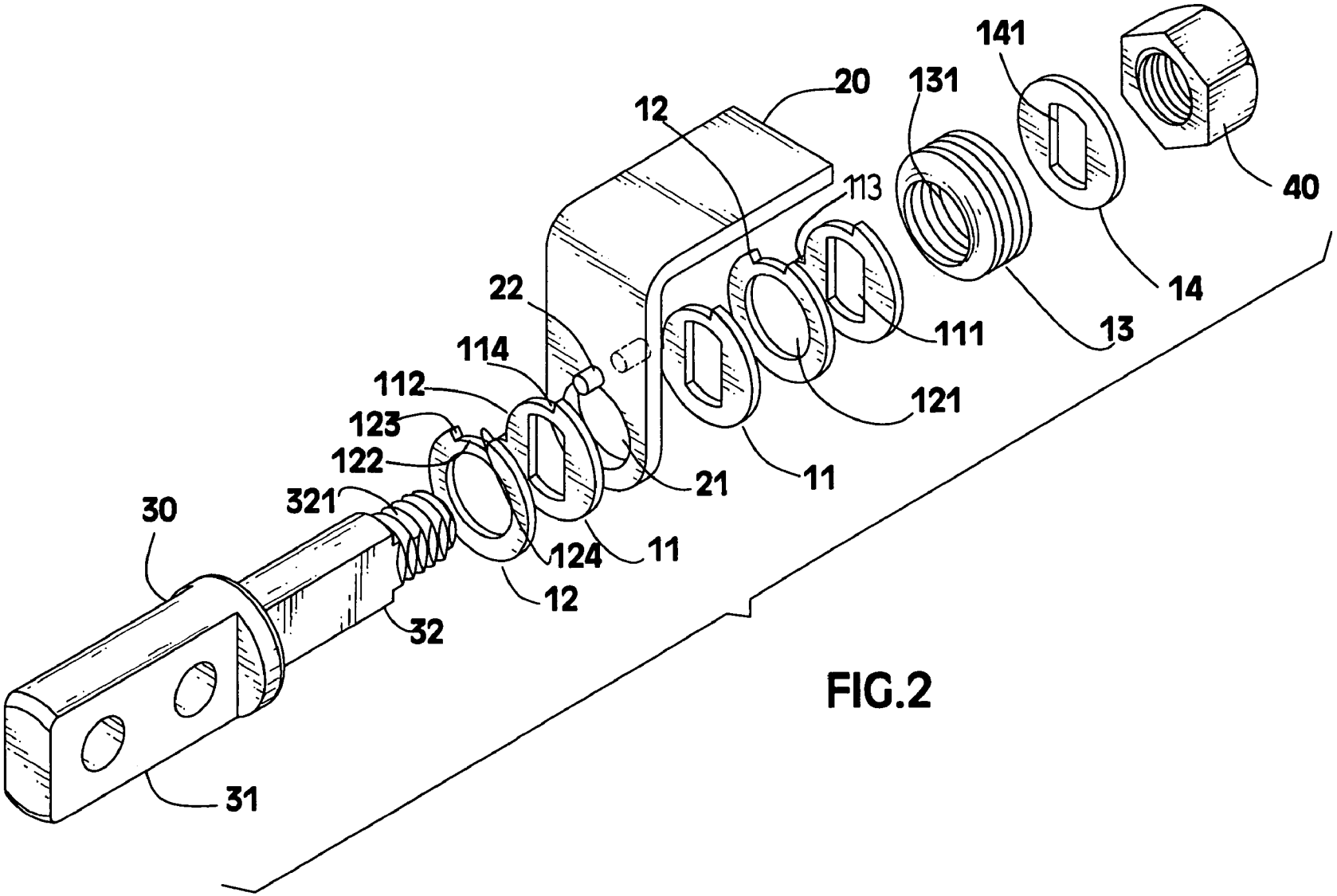
FIG. 2 is an exploded perspective view of the hinge in FIG. 1.

With further reference to FIG. 2, the spacer assembly (10) has three fixed spacers (11), two rotating spacers (12), a biasing device (13) and a washer (14).

Each fixed spacer (11) has a non-circular hole (111), an edge and a cut-out (112). The non-circular hole (111) is formed through each fixed spacer (11). The cut-out (112) is formed on the edge of each fixed spacer (11) and has a first end (113) and a second end (114). The cut-outs (112) have a length and align with each other.

Each rotating spacer (12) has a circular hole (121), an edge and a notch (122). The notch (122) is formed on the edge of each rotating spacer (12), aligns with the cut-outs (112) of the fixed spacers (11), and has a first end (123) and a second end (124). The notch (122) has a length. The length of the cut-out (112) of the fixed spacer (11) is longer than the length of the notch (122) of the rotating spacer (12).

The biasing device (13) has a circular hole (131) formed through the biasing device (13). The washer (14) has a non-circular hole (141) formed through the washer (14).

The rotating device (20) is an L-shaped pivot brake and has a distal end, a proximal end, a circular hole (21) and two protrusions (22). The proximal end is perpendicular to the distal end and has a first side and a second side. The circular hole (21) is formed through the proximal end. The protrusions (22) are formed respectively on the first side and the second side of the proximal end. The protrusions (22) are formed around the circular hole (21) and are movable along the cut-outs(112) and the notches (112) of the spacers (11, 12).

The pivot shaft (30) has a distal end, a proximal end, a fixed shaft (31), a penetrating shaft (32) and a thread (321). The fixed shaft (31) is formed on the proximal end. The penetrating shaft (32) is formed on the distal end and has a tip. The thread (321) is formed on the tip of the penetrating shaft (32).

When the spacer assembly (10) and the rotating device (20) are assembled, one of the fixed spacers (11) and one of the rotating spacers (12) are attached to the first side of the rotating device (20) and correspond to the circular hole (21) of the rotating device (20). One of the fixed spacers (11), one of the rotating spacers (12), the other fixed spacer (11), the biasing device (13) and the washer (14) are attached to the second side of the rotating device (20). The protrusions (22) extend into the respective cut-outs (112) and notches (122). Then the pivot shaft (30) is assembled with the spacer assembly (10) and the rotating device (20). The penetrating shaft (32) extends through the circular holes (121, 21, 131) of the rotating spacers (12), the rotating device (20) and the biasing device (13) and through the non-circular holes (111, 141) of the fixed spacers (11) and the washer (14). Then the nut (40) is screwed onto the thread (321) of the pivot shaft (30).

Figure 3:
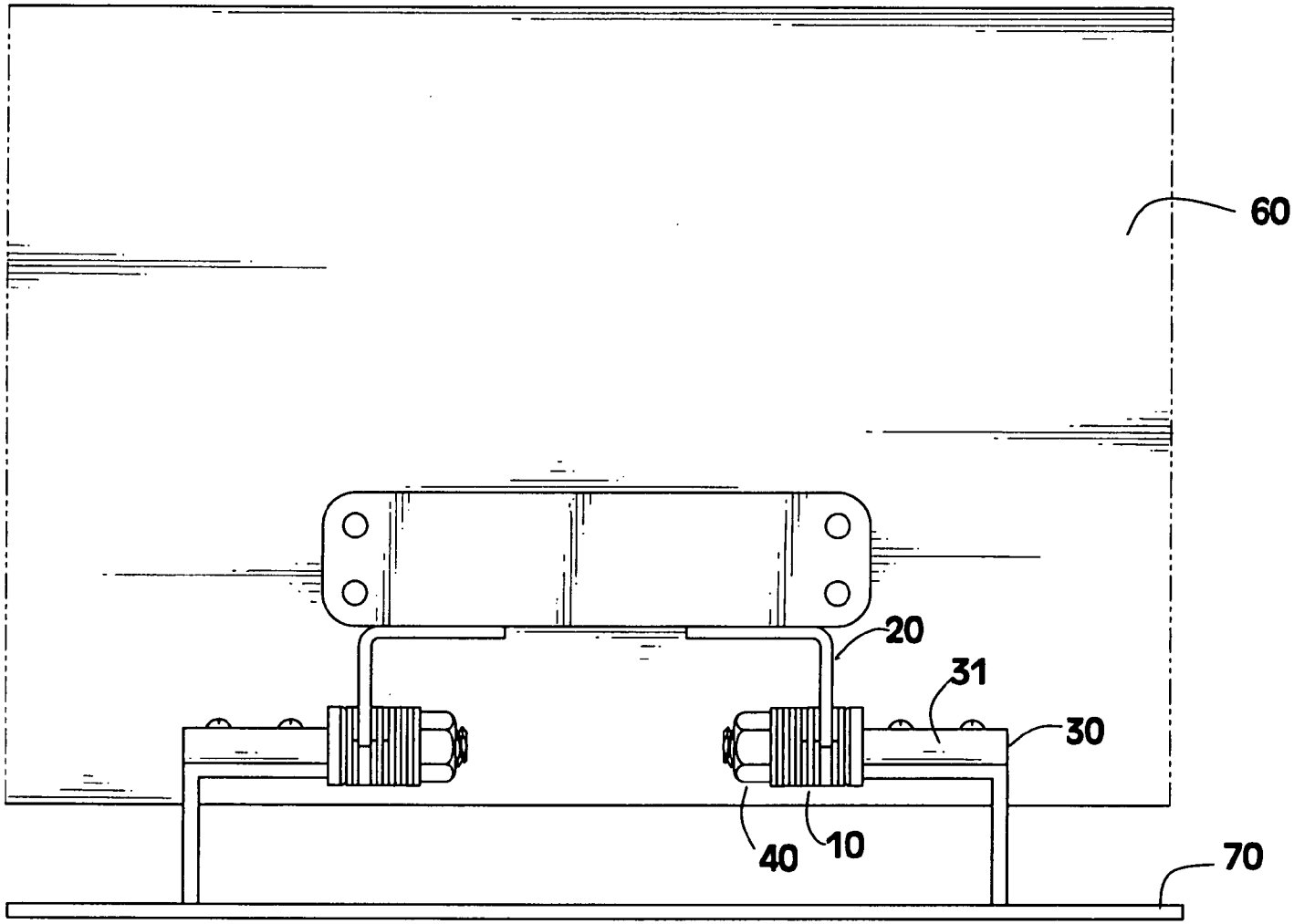
FIG. 3 is a side view of a LCD combined with two hinges in FIG. 1.

With further reference to FIG. 3, a liquid crystal display (LCD) comprises a screen (60) and a base (70). In this embodiment, two hinges are employed yet only one is referred to for the sake of brevity. The hinge is mounted between the screen (60) and the base (70). The distal end of the rotating device (20) is mounted on the screen (60). The fixed shaft (31) is mounted on the base (70).

Figure 7:
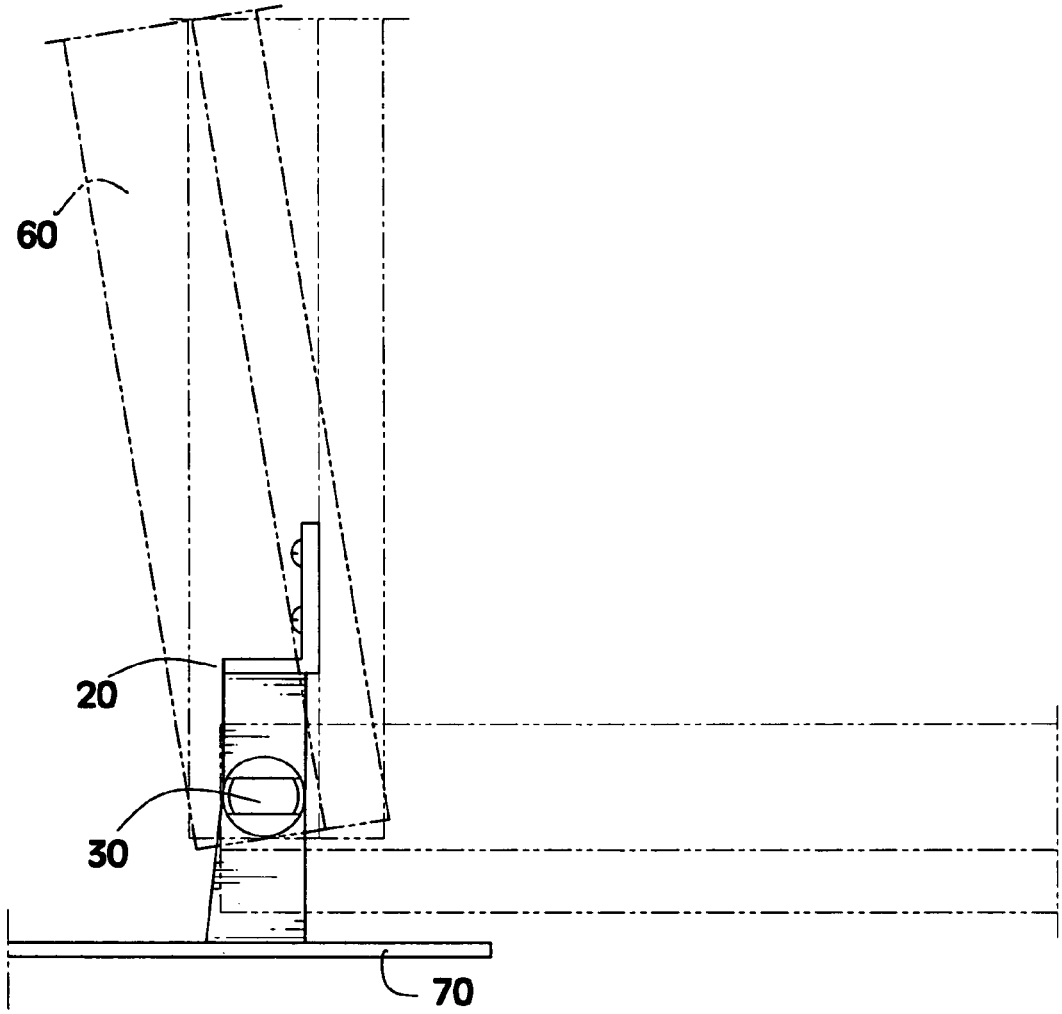
FIG. 7 is a side view of the LCD in FIG. 3 showing that the LCD is rotated.

With further reference to FIG. 7, when the screen (60) is pivoted relative to the base (70), the rotating device (20) is rotated by the screen (60). The circular holes (22, 122) of the rotating device (20) and the rotating spacers (12) are circular. The non-circular holes (111) of the fixed spacers (11) and the penetrating shaft (32) are non-circular. When the rotating device (20) is rotated, the penetrating shaft (32) will prevent the fixed spacers (11) from rotation. The protrusions (22) of the rotating device (20) are moved along the respective cut-outs (112) and the notches (122) of the spacers (11, 12). When the protrusions (22) of the rotating device (20) abut the ends (123, 124) of the notches (122), the rotating spacers (12) will be rotated by the rotating device (20).

Figure 4:
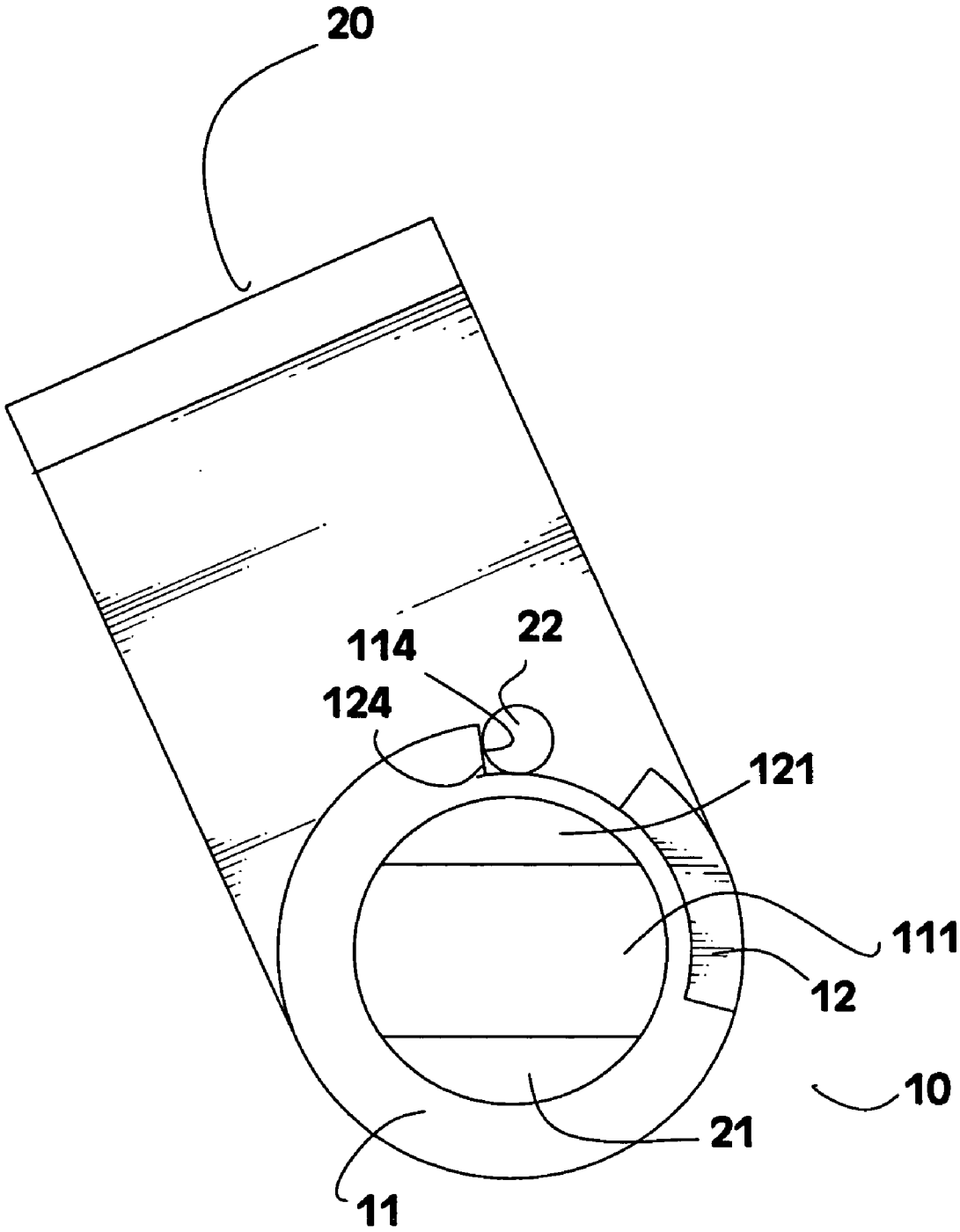
FIG. 4 is a side view of the hinge in FIG. 1 showing that the hinge is rotated backward.

With further reference to FIG. 4, the screen (60) and the rotating device (20) are rotated backward. The protrusions (22) of the rotating device (20) abut against the second ends (114, 124) of the cut-outs (112) and the notches (122). Because the fixed spacers (11) cannot be rotated, the screen (60) and the rotating device (20) can only be rotated to a small degree.

Figure 5:
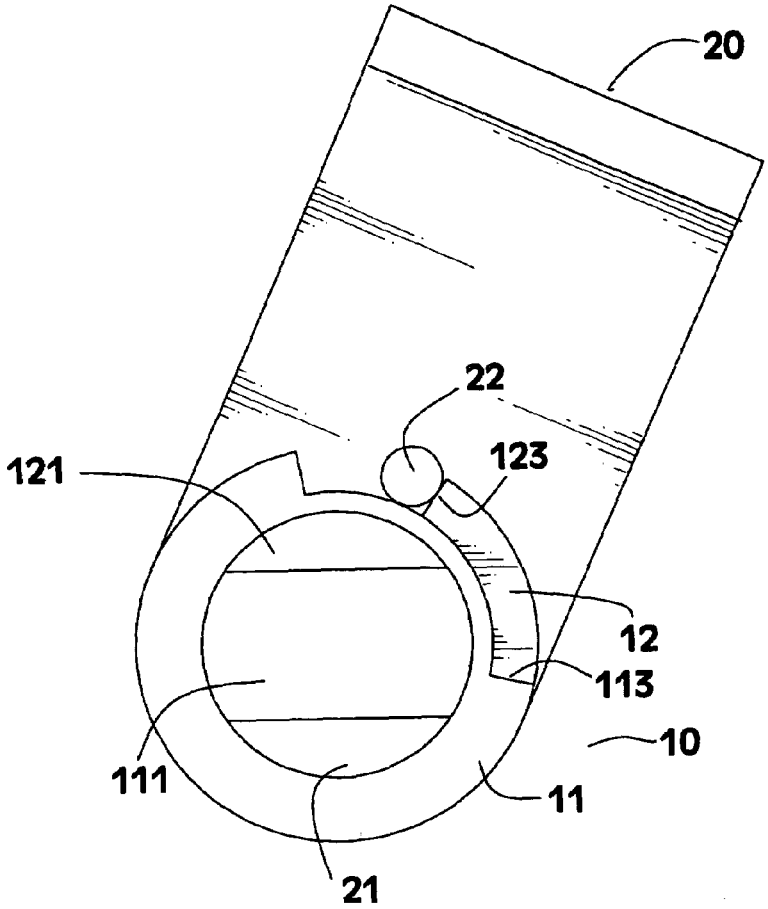
FIGS. 5 and 6 are operational side views of the hinge in FIG. 1 showing that the hinge is rotated forward.
Figure 6:
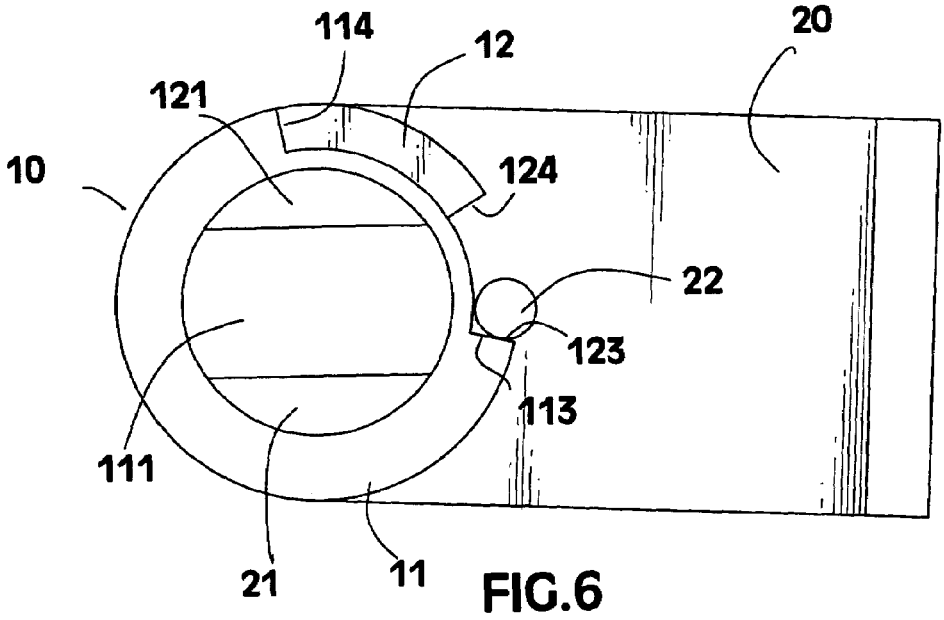

With further reference to FIG. 5, the screen (60) and the rotating device (20) are rotated forward. The protrusions (22) of the rotating device (20) abut against the first ends (123) of the notches (122). Then the screen (60) is positioned at this angle. With further reference to FIG. 6, the screen (60) and the rotating device (20) are exerted more strength to rotate further forward. The protrusions (22) abut against the first ends (123) and force the rotating spacers (12) to rotate. When the protrusions (22) abut against the first ends (113) of the cut-out (112), the rotating device (20) will be stopped from rotating. Then the screen (60) can be folded to be parallel to the base (70).

The hinge as described has a number of distinct advantages over a conventional hinge. The hinge can make the screen of the LCD to be folded to keep the screen (60) at a recumbent position. The contact surface of the recumbent screen is smaller than that of an upright screen, such that the recumbent screen (60) is not easily damaged when the LCD is shipping from a manufacturer to a retailer or moved from one desk to another. It is convenient for delivery of the LCD to fold the screen (60) to be parallel to the base (70). All components of the hinge are simple and easy to assemble.

Even though numerous characteristics and advantages of the present invention have been set forth in the foregoing description together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claim is:

1. A hinge comprising:

a spacer assembly having (a) multiple fixed spacers, wherein each fixed spacer has a non-circular hole formed through the fixed spacer, an edge, and a cut-out formed on the edge of the fixed spacer, the cut-out having a first end and a second end, the cut-outs of the fixed spacers being disposed in aligned relationship with each other, (b) multiple rotating spacers respectively disposed adjacent to the fixed spacer, wherein each rotating spacer has a circular hole formed through the rotating spacer, an edge, and a notch formed on the edge of the rotating spacer, the notch having a first end and a second end, the notches of the rotating spaces being disposed in aligned relationship with each other and with the cut-outs of the fixed spacers, (c) a biasing device disposed adjacent to a respective one of the spacers and having a circular hole formed through the biasing devices, and (d) a washer disposed adjacent to the biasing device and having a non-circular hole formed through the washer;

a rotating device having a proximal end disposed between a respective pair of the fixed spacers and a distal end, the rotating device being displaceable relative to the fixed spacers and the rotating spacers, the proximal end having a circular hole formed therethrough, the proximal end having at least one protrusion formed on a first side thereof adjacent the circular hole and movable respectively within the cutouts and the notches of at least a portion of the spacers;

a pivot shaft extending through the rotating device and the spacer assembly and having a distal end and a proximal end, the pivot shaft including a fixed shaft portion formed on the proximal end, a threaded portion formed on the distal end, and a penetrating shaft portion formed between the fixed shaft portion and the threaded portion, the penetration shaft portion penetrating through the circular holes of the rotating spacers, the rotating device and the biasing device and through the non-circular holes of the fixed spacers and the washer; and a nut screwed onto the threaded portion of the pivot shaft.

2. The hinge as claimed in claim 1, wherein the rotating device has two protrusions formed respectively on the first side and a second side of the proximal end for passage into the cut-outs and notches of respective fixed and rotating spacers.

3. The hinge as claimed in claim 2, wherein the spacer assembly includes three fixed spacers and two rotating spacers, one of the fixed spacers and one of the rotating spacers are disposed adjacent to the first side of the proximal end of the rotating device, and two of the fixed spacers and one of the rotating spacers are disposed adjacent to the second side of the proximal end of the rotating device.

* * * * *